United States Patent [19]

Cuntze et al.

[11] 3,956,143

[45] May 11, 1976

[54] PREPARATION FOR THE ANTISTATIC FINISHING OF FIBERS

[75] Inventors: Ulrich Cuntze, Hofheim, Taunus; Gustav Dollinger, Egelsbach; Rolf Kleber, Neu-Isenburg, all of Germany

[73] Assignee: Hoechst Aktiengesellschaft, Frankfurt am Main, Germany

[22] Filed: July 10, 1974

[21] Appl. No.: 487,313

[30] Foreign Application Priority Data

July 13, 1973 Germany ..... 2335674

[52] U.S. Cl. ..... 252/8.8; 428/279

[51] Int. Cl.[2] ..... D06M 13/36; D06M 13/46

[58] Field of Search ..... 252/8.8

[56] References Cited

UNITED STATES PATENTS

| | | | |
|---|---|---|---|
| 3,507,690 | 4/1970 | Walker | 252/8.8 |
| 3,738,864 | 6/1973 | Altau | 252/8.8 X |
| 3,749,674 | 7/1973 | Jones | 252/95 |
| 3,853,770 | 12/1974 | Altschuler | 252/8.8 |
| 3,892,526 | 7/1975 | Lofquist | 252/8.8 |

FOREIGN PATENTS OR APPLICATIONS

| | | | |
|---|---|---|---|
| 808,265 | 1/1959 | United Kingdom | 252/8.8 |

*Primary Examiner*—Donald E. Czaja
*Assistant Examiner*—Edward Woodberry
*Attorney, Agent, or Firm*—Connolly and Hutz

[57] ABSTRACT

Peralkylated reaction products of $\alpha$-olefin oxides of 8 to 18 carbon atoms with lower alkylene-diamines, dialkylene-triamines or trialkylene-tetramines are fiber lubricants which are capable of rendering the fibers antistatic.

1 Claim, No Drawings

PREPARATION FOR THE ANTISTATIC FINISHING OF FIBERS

In the dressing or finishing of sparingly hydrophilic synthetic fibers it is absolutely necessary to apply an antistatic component. The electrostatic charges occurring on synthetic fibers may sometimes be disturbing to such a degree that they strongly impede or render completely impossible the further processing of the fibers. With staple fibers, disturbances occur on the carding machine, but also on the batteur, the stretch-breaking machine and during conversion. With filaments, the charging-up tendency builts up especially strongly on the warp-beaming machine.

For an antistatic preparation, the following characteristics are important (K.Lindner; Tenside — Textilhilfsmittel — Waschrohstoffe, Volume II, pages 1616 et seq.; Stuttgart 1964):

a. parallel deposition of the individual molecules on the fiber surface vertically to the fiber surface;
b. polar structure of the antistatic agent with hydrophobic and hydrophilic groups and the presence of groups containing mobile electrons which respond to an electric field in the sense of a good dielectric by counter-polarisation.

Particularly effective antistatics are cation-active products such as quaternary ammonium compounds, the activity of which is assumed to be due to the transference of high conductivity. In order to impart on such products a low dynamic fiber/metal friction behaviour which is absolutely necessary for the satisfactory run in the fiber-producing shop as well as in the spinning mill, only such compounds are used in most cases in practice which contain long alophatic fat residues besides the quaternized nitrogen.

Owing to these fat alkyl residues, such compounds have a smoothing effect. Examples of such antistatics on the basis of quaternary ammonium compounds are described, for example in U.S. Pat. Nos. 3,074,815 and 3,048,539.

Most of the known antistatics have the disadvantage that, under normal conditions, they have the form of a paste and that, therefore, they first must be brought into a form suitable for processing by boiling them up with water. This disadvantageous property prevents the transportation of such products through pipe lines with the aid of pumps; the dissolution with boiling water is not only cumbersome but it also restricts the use of such products to plants which meet these requirements with regard to machinery.

The hitherto known liquid quaternary ammonium compounds which are soluble in cold water, on the other hand, have the disadvantage that they do not permit to obtain the good softening effect like that obtained with pasty products.

Now, we have found that liquid concentrates of quaternary ammonium compounds which are dilutable with cold water and which impart onto the finished fiber in addition to an outstanding antistatic effect also an agreeable smoothening soft handle as that hitherto obtained only with pasty products.

According to the invention, there are used compounds of the formula (1)

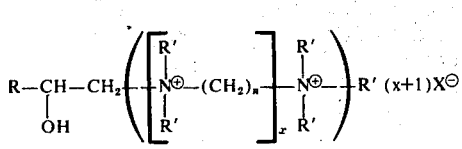

(1)

In this formula, R represents an alkyl group of 6 to 16 carbon atoms, R′ represents identical or different lower alkyl groups, preferably ethyl groups and, in particular, methyl groups, X represents a chloride ion, a lower alkyl-sulfate ion or a tosylate ion, preferably chloride or ethosulfate and, in particular, methosulfate, x represents an integer from 1 to 3 and *n* represents 2 or 3.

The radical

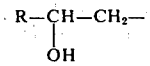

is prferably bound to a terminal nitrogen atom, if *x* is 2 or 3.

The invention also relates to an aqueous fiber finishing preparation which contains compounds of the formula (1) having about 20 to about 50% by weight of active substance, if desired in combination with the usual finishing agents.

The fibers finished according to the invention are in particular synthetic fibers, especially fibers of polyesters such as polyethylene-glycol terephthalate, polyamides such as polyamide-6 and polyamide-6.6, polyacrylonitrile and cellulose acetates.

The salts of the formula (1) used according to the invention are products obtained by the reaction of 1 mole of an epoxide of the formula (2)

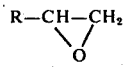

(2)

in which R represents an alkyl group of 6 to 16 carbon atoms, with 1 mole of an amine of the formula (3)

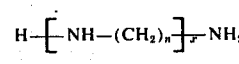

(3)

in which *n* is 2 or 3 and *x* is 1, 2 or 3, and subsequent peralkylation with, preferably, stoichiometrical amounts or a slight excess of an alkylating agent of the formula (4)

$$R' - X$$

in which R′ represents a lower alkyl group, preferably ethyl, in particular methyl, and X represents chloride, lower alkyl sulfate or tosylate. In this reaction, the epoxide reacts preferably, but not necessarily merely, with a primary amino group so that the reaction products generally correspond preponderantly to the formula (5)

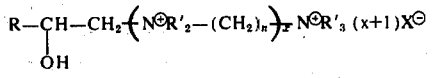

(5)

It is also possible, however in general not advantageous, to use an amine of the formula (3) which is already more or less alkylated. Furthermore, it is possible to use in the reaction different alkylating agents of the formula (4), either simutaneously or successively.

It is, however, preferred to proceed in the manner described hereinbefore whereby products of the formula (1) are obtained in which R' represents identical lower alkyl groups.

Preferred epoxides of the formula (2) are the commercial α-olefin-oxides containing 9 to 16 carbon atoms and which are usually mixtures of products of various chain lengths.

Among the amines of the formula (3) those are preferred in which the index $n$ in the molecule, if it is present several times ($x = 2$ or 3), is identical, as in diethylene-triamine, triethylene-tetramine, dipropylene-triamine or tripropylene-tetramine. Preferably, $x$ in formula (3) is 1 or 2, and $n$ is 2.

The reaction of the epoxide of the formula (2) with the amines of the formula (3) is carried out at elevated temperature, preferably at a temperature in the range of from about 50° to 200° C, in particular from 120° to 170° C. The reaction with the alkylating agent of the formula (4) is carried out at temperatures in the range of from about 20° to about 120° C, preferably from about 40° to about 100° C, in particular from about 50° to about 80° C. It is not necessary to use $2x + 3$ moles of alkylating agent, because products which contain a lower amount of not peralkylated compounds are likewise active. The concentrates of the compounds (1) obtained in the form of liquids are miscible with cold water to an unlimited degree. The concentrates or the dilute solutions prepared with them can be applied onto the fibers in known manner, for example by means of lick-rollers (kiss-rollers), by immersion or spraying. When applied in a quantity of about 0.1 to about 3%, preferably about 0.2 to about 1%, referred to the weight of the fiber, they produce outstanding antistatic effects which are stable also at low air moistures. In addition thereto, the compounds used according to the invention impart a smooth and soft handle.

The products of the formula (1) can be used alone or in combination with other finishing agents usually employed in the manufacture of fibers, for example lubricants (sliding promoters), products yielding a good cohesion of single filaments and emulsifiers. Owing to their high substantivity, the products may also be applied from a long (low-concentrated) bath, for example from dyebaths. In this case, in addition to a high antistatic effect also a good softening effect is imparted on the fibers which facilitates the further processing on weaving, knitting and loop knitting machines.

The following Examples illustrate the invention. In these examples and the preparation methods described, the percentages are percents by weight.

The following preparation methods A to E describe advantageous methods for the preparation of stable liquid concentrates having a content of active substance of up to about 50%.

A. 41.6 g (0.4 mole) of diethylene-triamine and 101.2 g (0.4 mole) of an α-olefin-oxide having a chain length of 13 to 16 carbon atoms were stirred for 3 hours at 150° C under reflux. The whole was cooled, the slightly yellow product (Epon number (mg HCL/g of substance) = O) was diluted with 340 ccm. of water and 252 g (2 moles) of dimethyl sulfate were added dropwise at 60° – 70° C. The pH-value was kept over 9.0 by simultaneous dropwise addition of 190 g of a 33% sodium hydroxide solution. After completion of the addition of dimethyl sulfate, the mixture was neutralized with glacial acetic acid. A liquid was obtained which contained 47% of solid substance.

B. 41.6 g (0.4 mole) of diethylene triamine and 85.2 g (0.4 mole) of an α-olefin-oxide having a chain length of 9 to 12 carbon atoms were stirred for 3 hours at 150° C under reflux. The whole was cooled, the slightly yellow product (Epon number = O) was diluted with 420 ccm. of water and 370 g (2.4 mole) of diethyl sulfate were added dropwise at 60° – 70° C. The pH-value was kept over 9.0 by the simultaneous dropwise addition of 240 g of 33% sodium hydroxide solution. After completion of the addition of diethyl sulfate, the mixture was neutralized with glacial acetic acid. A liquid was obtained which contained 48% of solid substance.

C. 41.6 g (0.4 mole) of diethylene triamine and 101.2 g (0.4 mole) of an α-olefin-oxide having a chain length of 13 to 16 carbon atoms were stired for 3 hours at 150° C under reflux. The whole was cooled, the slightly yellow product (Epon number = O) was diluted with 315 ccm of water and 353 g (2.8 moles) of dimethyl sulfate were added dropwise at 60° – 70° C. The pH-value was kept over 9.0 by the simultaneous dropwise addition of 300 g of 33% sodium hydroxide solution. After completion of the addition of dimethyl sulfate, the mixture was neutralized with glacial acetic acid. A liquid was obtained which contained 45% of solid substance.

D. 52.4 g (0.4 mole) of dipropylene triamine and 101.2 g (0.4 mole) of an α-olefin-oxide having a chain length of 15 to 18 carbon atoms were heated for 3 hours to 150° C. An oil was obtained (Epon number 0) which was mixed with 566 g of water at 60° C. At this temperature, 353 g (2.8 moles) of dimethyl sulfate were added dropwise. The pH-value was kept over 9.0 by the simultaneous dropwise addition of 33% sodium hydroxide solution. Then, the pH-value was adjusted to 7.0 by means of glacial acetic acid. The soultion so obtained contained 45% of solid substance.

E. 29.2 g (0.2 mole) of triethylene tetramine and 50.6 g (0.2 mole) of an α-olefin-oxide having a chain length of 15 to 18 carbon atoms were heated for 3 hours to 150° C. An oil was obtained (Epon number 0) which was stirred with 440 g of water at 60° C. At this temperature, 227 g (1.8 moles) of dimethyl sulfate were added dropwise. The pH-value was kept over 9.0 by the simultaneous dropwise addition of 33% sodium hydroxide solution. Then, the pH-value was adjusted to 7.0 by means of glacial acetic acid. The solution so obtained contained 46% of solid substance.

EXAMPLES

1. Endless filaments of polyethylene-glycol tere phthalate (dtex 167 *f 32*) were treated, after spinning and stretching, with about 50% solutions of the following substances:

a. a condensation product of 1 mole of stearic acid and 1 mole of triethylene tetramine, perquaternized with dimethyl sulfate
(comparative product, pasty, soluble only when boiled up with water):
b. the product obtained by method A;
c. the product obtained by method B In all cases, the quantity of active substance applied onto the fiber was 0.7 %. Drying was effected over heated lick-rollers (kiss-rollers) at 80°C. After this treatment, the following antistatic values in MΩ were determined at 22°C and a relative air moisture of 65%.

a. 3.5
b. 1.0
c. 1.1

The handle of all filaments texturated after the finishing was soft, smooth and agreeable. Similar effects were obtained when using the products obtained according to methods C and D.

2. Polyacrylonitrile flocks were treated, after dyeing, in a laboratory dyeing apparatus at a goods-to-liquor ratio of 1:10 at 40° C, for 1 hour with 1.5% aqueous solutions of the following products:

a. the comparative product of Example 1 a;
b. the product obtained by method C;
c. the product of the formula

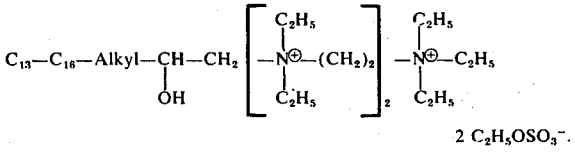

Whereas the pasty comparative product a) could be dissolved only by boiling up with water, the clear concentrates of products b) and c) could be added after dilution with cold water directly to the dyebath.

The following antistatic effects were measured at 25° C/35% of relative air moisture:

a. 19 MΩ
b. 12 MΩ
c. 14 MΩ

The thus finished polyacrylonitrile flocks showed with better antistatic values a high spring elasticity and an agreeable soft handle.

Similar effects were obtained when using the products obtained by methods B, D and E.

We claim:

1. A liquid antistatic composition consisting essentially of 50 to 80% by weight of water and 20 to 50% by weight of a compound of the formula

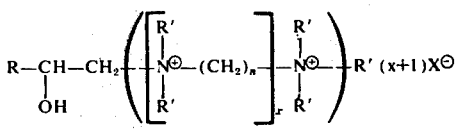

in which R is alkyl of 6 to 16 carbon atoms, R′ stands for the same or different lower alkyls, X is chloride, lower alkylsulfate or tosylate, *n* is 2 or 3 and *x* is 1,2 or 3.

* * * * *